US008833578B1

(12) United States Patent
Shell-Schnitzer

(10) Patent No.: US 8,833,578 B1
(45) Date of Patent: Sep. 16, 2014

(54) BOTTLE ASSEMBLY

(71) Applicant: Benjamin Shell-Schnitzer, New York, NY (US)

(72) Inventor: Benjamin Shell-Schnitzer, New York, NY (US)

( * ) Notice: Subject to any disclaimer, the term of this patent is extended or adjusted under 35 U.S.C. 154(b) by 0 days.

(21) Appl. No.: 14/060,990

(22) Filed: Oct. 23, 2013

Related U.S. Application Data

(63) Continuation-in-part of application No. 29/464,665, filed on Aug. 20, 2013.

(60) Provisional application No. 61/789,806, filed on Mar. 15, 2013, provisional application No. 61/737,397, filed on Dec. 14, 2012.

(51) Int. Cl.
*B65D 41/02* (2006.01)

(52) U.S. Cl.
CPC ..... *B65D 41/02* (2013.01)
USPC ..... 215/223; 215/201; 215/303

(58) Field of Classification Search
CPC ..... B65D 51/18; B65D 55/02; B65D 41/023
USPC ..... 215/223
See application file for complete search history.

(56) References Cited

U.S. PATENT DOCUMENTS

| | | | | |
|---|---|---|---|---|
| 3,764,033 | A | 10/1973 | Smith et al. | |
| 4,284,201 | A | 8/1981 | Nixon | |
| 4,991,729 | A | 2/1991 | Hunter | |
| 4,998,632 | A | 3/1991 | Morris, Sr. | |
| 5,148,931 | A | 9/1992 | Minh | |
| 5,158,194 | A | 10/1992 | Sirgo et al. | |
| 5,344,035 | A * | 9/1994 | Manera | 215/219 |
| 5,411,161 | A * | 5/1995 | Fish, Jr. | 220/293 |
| 5,579,934 | A | 12/1996 | Buono | |
| 5,699,922 | A | 12/1997 | Harding | |
| 6,202,869 | B1 | 3/2001 | Sullivan | |
| 8,292,110 | B2 | 10/2012 | Rutter et al. | |
| 8,316,622 | B2 | 11/2012 | Jajoo et al. | |
| 8,453,873 | B2 | 6/2013 | Zielinski et al. | |
| 2007/0199912 | A1 | 8/2007 | Libohova et al. | |
| 2007/0267379 | A1 | 11/2007 | Creasap | |
| 2008/0142519 | A1 * | 6/2008 | Chou | 220/253 |
| 2011/0174759 | A1 | 7/2011 | Titherington | |

FOREIGN PATENT DOCUMENTS

| | | | |
|---|---|---|---|
| GB | 2 099 801 | A | 12/1982 |

* cited by examiner

*Primary Examiner* — Anthony Stashick
*Assistant Examiner* — Raven Collins
(74) *Attorney, Agent, or Firm* — Muirhead and Saturnelli, LLC

(57) ABSTRACT

A bottle assembly is disclosed having a container component and a lid assembly. The lid assembly includes an outer lid and an inner lid that are aligned with each other and with a rim section of the bottle assembly in order to be removed. The bottle assembly advantageously provides that no complex threading, ratcheting mechanism or push tabs are required to provide locking functionality while still providing beneficial child-resistant safety features.

14 Claims, 9 Drawing Sheets

FIG. 2
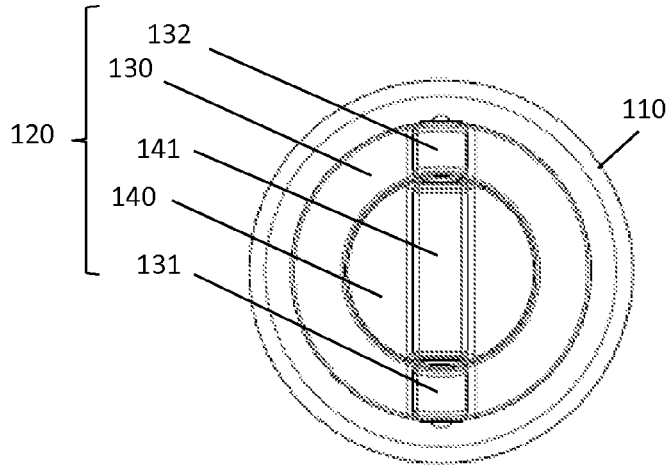
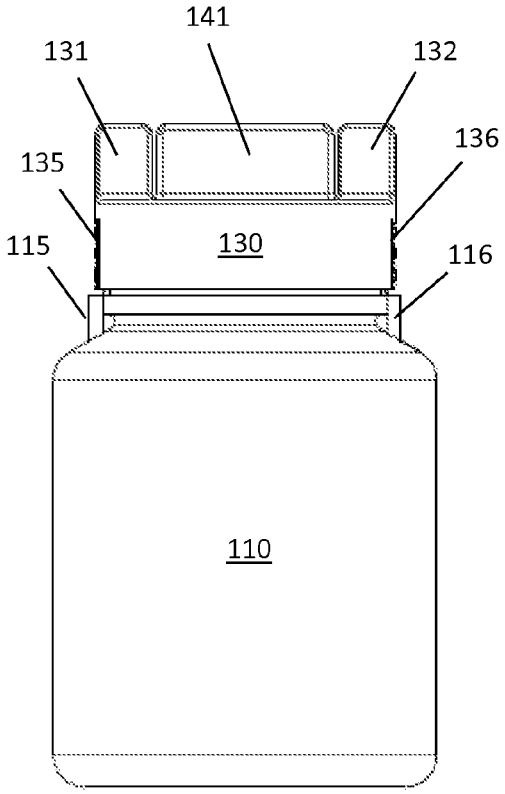
FIG. 3
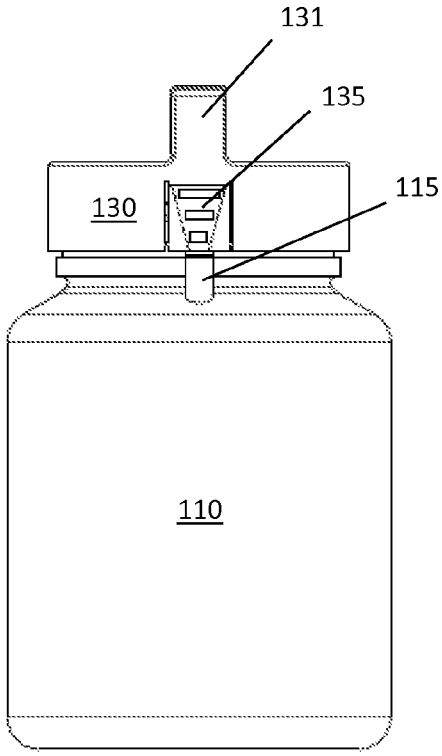
FIG. 4

FIG. 5
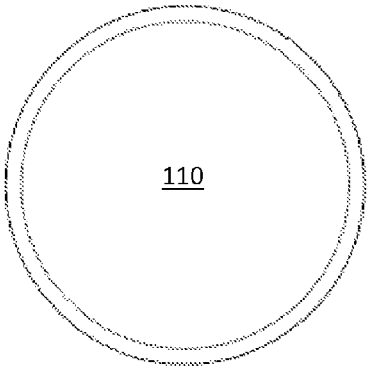
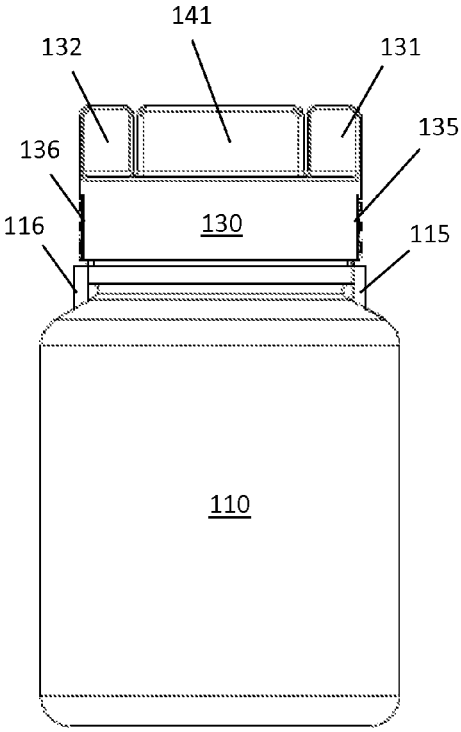
FIG. 6
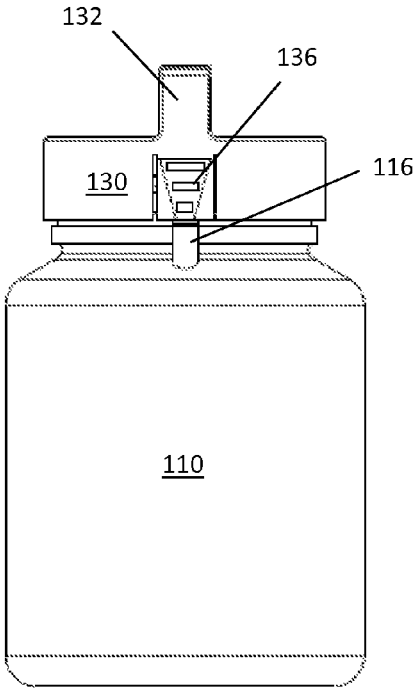
FIG. 7

SECTION Z-Z

BOTTLE ASSEMBLY

RELATED APPLICATIONS

This application claims priority to U.S. Provisional App. 61/789,806 filed Mar. 15, 2013, and to U.S. Provisional App. 61/737,397 filed Dec. 14, 2012, both of which are incorporated herein by reference. This application is also a continuation-in-part of U.S. Design App. 29/464,665 filed Aug. 20, 2013, which is incorporated herein by reference.

TECHNICAL FIELD

This application is related to the field of containers, particularly bottles.

BACKGROUND OF THE INVENTION

Bottles, such as prescription or pill bottles, may have contents that are dangerous to children if ingested. Accordingly, bottles have been developed with child resistant features to prevent unintended access by a child to the dangerous contents. Known child-resistant cap or lid features include push-down-and-rotate lids, hard press-off lids, and squeezable tabs on a lid that must be squeezed to release the lid from the bottle. However, such child-resistant features may cause problems in some cases for adults accessing the contents of the bottle, particularly for elderly persons. For example, push-down-and-rotate features may be difficult for an elderly person to operate if they have arthritis or the lack of digital strength or dexterity. Hard press-off features may hurt or cause discomfort for someone's fingertips, or may cause the lid to fly off and fall to the floor. Squeezable tabs may be difficult to operate if the person does not have the digital strength or dexterity. For an example of a known child resistant cap assembly for a bottle, reference is made to U.S. Pat. No. 8,316,622 B2 to Jajoo et al., entitled "Child-Resistant Cap," which is incorporated herein by reference.

Accordingly, it would be desirable to provide a bottle that offers child-resistant safety features and yet also facilitates easy access to the bottle by adults to mitigate the problems noted above.

SUMMARY OF THE INVENTION

According to the system described herein, a bottle assembly is provided having a container component and a lid assembly that engages with the container component and is rotatable with respect to the container component. The lid assembly includes an outer lid and an inner lid, and the inner lid is independently moveable with respect to the outer lid. The lid assembly provides child-resistant removal features such that the lid assembly is removable from the container component only when the inner lid is positioned at a first specified alignment with respect to the outer lid, and when the outer lid is positioned at a second specified alignment with respect to the container component. The inner lid may be positioned within a circumference of the outer lid, and the inner lid may be independently rotatable with respect to the outer lid. The inner lid may include a handle piece that is aligned with at least one other handle piece of the outer lid in the first specified alignment of the inner lid and the outer lid, and in which the inner lid and the outer lid are both aligned in the second specified alignment with respect to the container component. The container component may include a rim section having at least one opening, and the second specified alignment of the outer lid may be an alignment of the outer lid with respect to the at least one opening of the rim section of the container component. The rim section of the container component may include at least one lug that provides an indication of a location of the at least one opening of the rim section. The outer lid and the inner lid may each include at least one tab that engages with the rim section, and the at least one tab of each of the outer lid and the inner lid may be aligned in the first specified alignment of the inner lid with respect to the outer lid. Each of the at least one tabs engages with a rib of the rim section to provide child-resistant removal features of the lid assembly when the lid assembly is not in the first specified alignment of the inner lid with respect to the outer lid or in the second specified alignment of the outer lid with respect to the container component. The outer lid may include at least one visual or tactile aid to facilitate alignment of the outer lid in the second specified alignment of the outer lid with respect to the container component.

According further to the system described herein, a method for providing child-resistant access to a bottle assembly includes providing the bottle assembly with a container component and a lid assembly that engages with the container component and is rotatable with respect to the container component. The lid assembly includes an outer lid and an inner lid. The inner lid is independently moveable with respect to the outer lid. The method includes providing child-resistant removal features of the bottle assembly that the lid assembly is removable from the container component only when the inner lid is positioned at a first specified alignment with respect to the outer lid, and when the outer lid is positioned at a second specified alignment with respect to the container component. The inner lid may be positioned within a circumference of the outer lid, and the inner lid may be independently rotatable with respect to the outer lid. The inner lid may include a handle piece that is aligned with at least one other handle piece of the outer lid in the first specified alignment of the inner lid and the outer lid, and in which the inner lid and the outer lid are both aligned in the second specified alignment with respect to the container component. The container component may include a rim section having at least one opening, and the second specified alignment of the outer lid may be an alignment of the outer lid with respect to the at least one opening of the rim section of the container component. The rim section of the container component may include at least one lug that provides an indication of a location of the at least one opening of the rim section. The outer lid and the inner lid may each include at least one tab that engages with the rim section, and the at least one tab of each of the outer lid and the inner lid may be aligned in the first specified alignment of the inner lid with respect to the outer lid. Each of the at least one tabs engages with a rib of the rim section to provide child-resistant removal features of the lid assembly when the lid assembly is not in the first specified alignment of the inner lid with respect to the outer lid or in the second specified alignment of the outer lid with respect to the container component. The outer lid may include at least one visual or tactile aid to facilitate alignment of the outer lid in the second specified alignment of the outer lid with respect to the container component.

BRIEF DESCRIPTION OF THE DRAWINGS

Embodiments of the system described herein are explained with reference to the several figures of the drawings, which are briefly described as follows.

FIG. 2 is a top plan view showing the bottle according to the embodiment of FIG. 1.

FIG. 3 is a left side elevational view of the bottle according to the embodiment of FIG. 1.

FIG. 4 is a front elevational view of the bottle according to the embodiment of FIG. 1.

FIG. 5 is a bottom plan view of the bottle according to the embodiment of FIG. 1.

FIG. 6 is a right side elevational view of the bottle according to the embodiment of FIG. 1.

FIG. 7 is a back elevational view of the bottle according to the embodiment of FIG. 1.

DETAILED DESCRIPTION OF VARIOUS EMBODIMENTS

According to the system described herein, a bottle assembly is provided that advantageously requires no complex threading, ratcheting mechanisms or push tabs to provide locking functionality while still providing beneficial safety features, such as child-resistant features.

Figure 1:
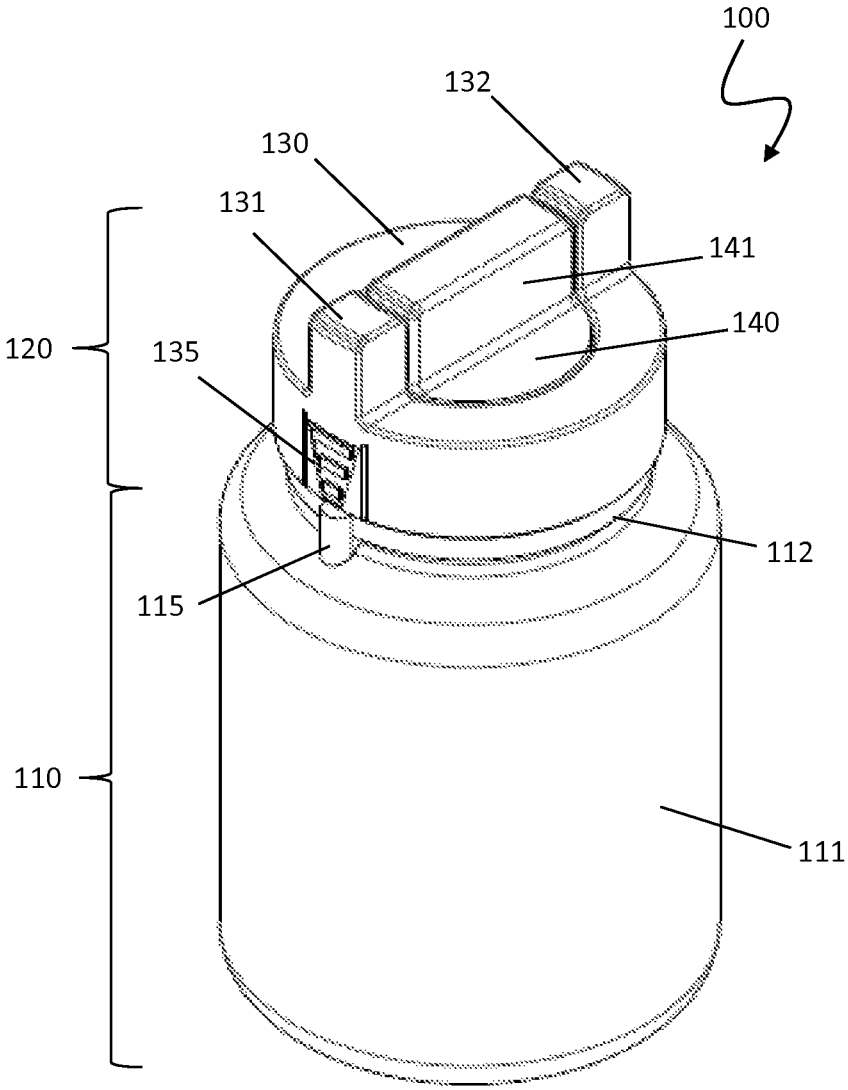
FIG. 1 is a schematic illustration showing a bottle assembly (bottle) according to an embodiment of the system described herein.

FIG. 1 is a schematic illustration showing a bottle assembly (bottle) 100 according to an embodiment of the system described herein. The bottle 100 may include a container component 110 and a lid assembly 120. The container component 110 may include a bottle volume 111 and a rib 112 with which the lid assembly 120 engages. A lug 115 may be disposed on or adjacent to the rib 112 that indicates an opening in the rib 112 which facilitates removal of the lid assembly 120 according to a removal procedure, as further discussed elsewhere herein. As shown and described elsewhere herein, the bottle assembly 100 may include multiple lugs (see, e.g., lug 116 shown elsewhere herein). The lid assembly 120 may include an outer lid 130 and an inner lid 140. The inner lid 140 may rotate separately or independently from the outer lid 130 and both lids may rotate with respect to the container component 110. The inner lid 140 may be rotated by the user grasping a handle piece 141 and turning the inner lid 140 using the handle piece 141. The outer lid 130 may be rotated by the user grasping the handle pieces 131, 132 and turning the outer lid 130 using the handle pieces 131, 132.

In the illustrated embodiment, the outer lid 130 is shown aligned with the inner lid 140, such that the handle pieces 141, 131 and 132 are in alignment. The handle pieces 141, 131, 132 are further shown in alignment with the lugs 115, 116 on the rib 112. It is also noted that the lugs 115, 116 may be sized (e.g., oversized) to make it easy for an elderly person to feel where the lugs are on the bottle assembly 100 and in relation to the lid assembly 120. In an embodiment, an embossed mark 135 (e.g., an arrow) may be included that is shown by way of example on the outer lid 130 as a visual and/or tactile aide. The mark 135 on the bottom of the outer lid 130 may provide a feature that the person feels with their fingers to give them "feedback" where the lugs 115, 116 on the lid assembly 120 are in relation to the mark 135. This may be advantageous for someone who is legally blind, for example, in removing the lid assembly 120 from the container component 110.

Figure 8:
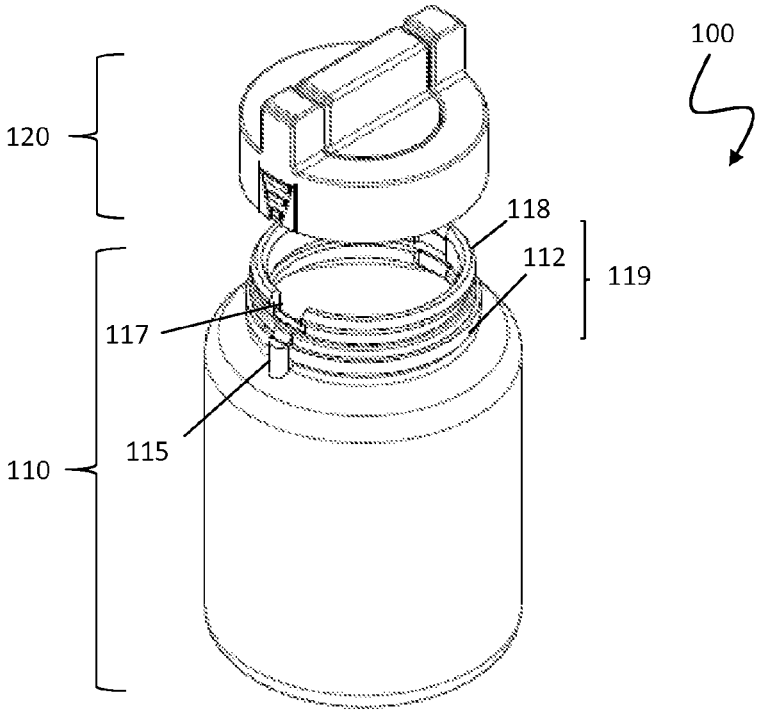
FIG. 8 is a schematic illustration of the bottle showing the lid assembly separated from the container component according to an embodiment of the system described herein.
Figure 9:
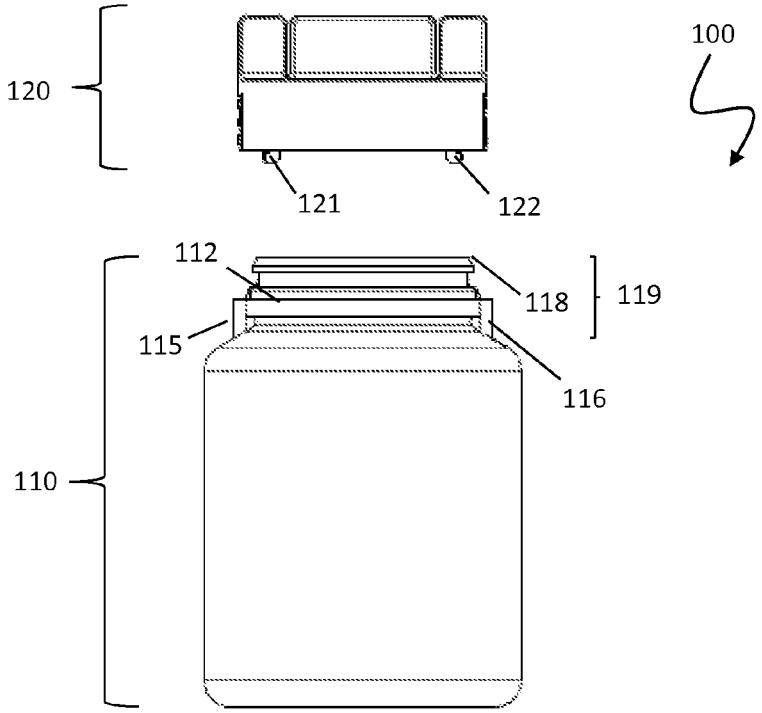
FIG. 9 is side view of the bottle with lid assembly separated from the container component according to the embodiment of FIG. 8.

A rim section of the container component may be tapered, on the inside and outside, that allows tabs of the lid assembly 120 to flare out as the user puts the lid back on the bottle 100 (refer, e.g., to FIGS. 8 and 9). To remove the lid assembly 120, the user may align both the inner and outer lids 130, 140 together with the lugs 115, 116 on the rib 112 on the bottle 100 and lift off the lid assembly 120. To install the lid assembly 120, the user may press the lid assembly 120 onto the container component 110 of the bottle 100. It is noted that installing the lid assembly 120 on the container component 110 does not require alignment with openings or lugs nor alignment of the outer lid 130 and the inner lid 140.

FIGS. 2-7 show plan and elevational views of the bottle assembly according to the embodiment of FIG. 1. FIG. 2 is a top plan view. FIG. 3 is a left side elevational view. FIG. 4 is a front elevational view of the bottle assembly. FIG. 5 is a bottom plan view. FIG. 6 is a right side elevational view of the bottle assembly. FIG. 7 is a back elevational view. Identified elements from FIG. 1 are shown in FIGS. 2-7. As further shown in the figures, in various embodiments, additional lugs, such as the lug 116, may be used in addition to the lug 115 described elsewhere herein. Further, another embossed mark 136 is shown as a visual and/or tactile aide in addition to the mark 135 discussed elsewhere herein.

FIGS. 8 and 9 are schematic illustrations of the bottle 100 showing the lid assembly 120 separated from the container component 110 according to an embodiment of the system described herein. The top of the container component 110 may include a rim section 119 that includes the rib 112 and lugs 115, 116 discussed elsewhere herein. An opening 117 in the rim section 119 is shown above the lug 115 that facilitates removal of the lid assembly 120 from the container component 110 when the lid assembly 120 is properly aligned with respect to the opening 117. There may be a corresponding opening on the other side of the rim section 119. Tabs 121, 122 of the lid assembly 120 are thereby aligned with the opening(s) 117 of the rim section 119 such that lid assembly may be removed. A lip 118 of the rim section 119 may be tapered, on the inside and outside, that the allows tabs 121, 122 of the lid assembly 120 to flare out when the user puts the lid assembly 120 back on the bottle 100. The tapered edges of the tabs 121, 122 on the lid assembly 120 and of the lip 118 on the rim section 119 of the container component 110 allow easy access of the lid assembly 120 onto the container component 110 of the bottle 100. The tabs 121, 122 are shown as tabs of the inner lid 140. The outer lid 130 also has tabs the function like that of the tabs 121, 122, such that removal of the lid assembly 120 involves alignment of the inner lid 140, outer lid 130 and the opening(s) 117 of the rim section 119 of the container component 110 (refer, for example, to FIG. 16).

Figure 10:
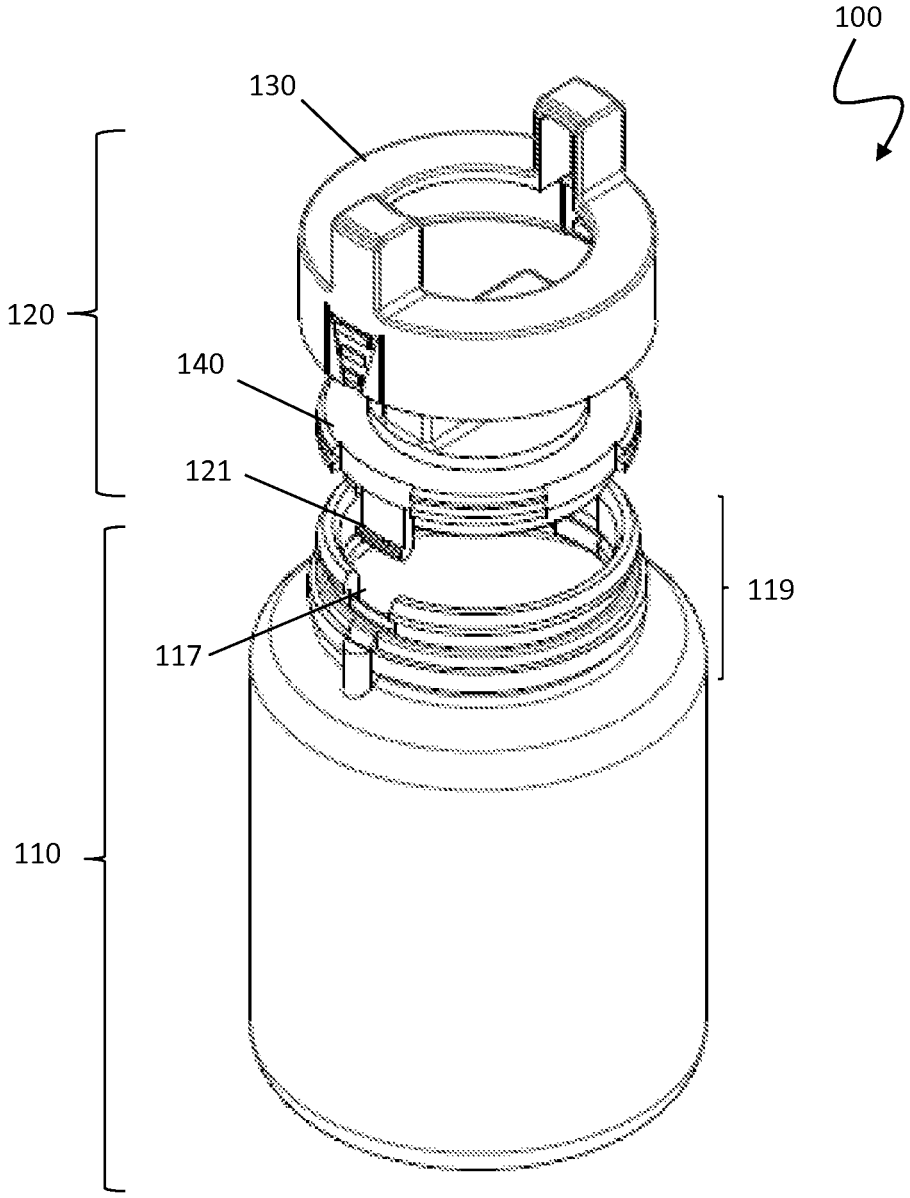
FIG. 10 is an exploded view of the bottle according to the embodiment of FIG. 1.

FIG. 10 is an exploded view of the bottle 100 according to an embodiment of the system described herein. The exploded view shows the separate elements of the container component 110 and the outer lid 130 and inner lid 140 of the lid assembly 120. Generally, in various embodiments, the outer lid 130 and the inner lid 140, although being rotatable with respect to each other according the operations and features discussed herein, are coupled together as a unit forming the lid assembly 120, and when opening the bottle 100, the lid assembly 120 is removed as a single unit to access the contents of the container component 110.

Figure 11:
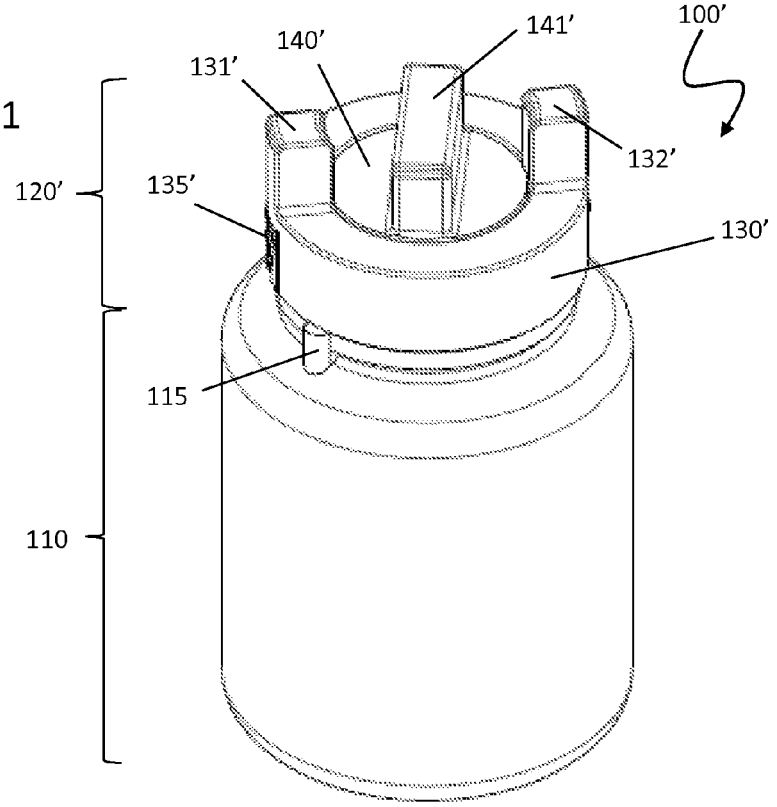
FIG. 11 is a schematic illustration showing the bottle in a different operational state according to an embodiment of the system described herein.
Figure 12:
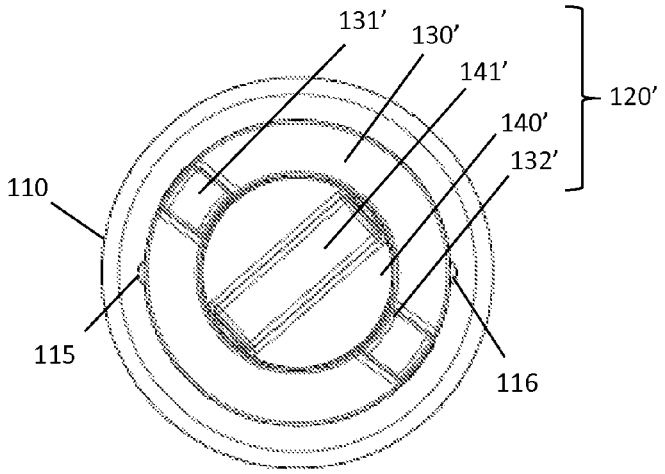
FIG. 12 is top plan view of the bottle in the different operational state according to the embodiment shown in FIG. 11.

FIGS. 11 and 12 are schematic illustrations showing the bottle having the features discussed herein in a different operational state, illustrated as bottle 100', according to an embodiment of the system described herein. Elements of the bottle 100' that are presented in the different operational state are identified with reference numerals corresponding to that discussed elsewhere herein but with the addition of a prime (') notation. FIG. 11 is a perspective view and FIG. 12 is a top plan view of the bottle 100' in the different operational state. Specifically, the bottle 100' is shown in a state in which the outer lid 130' (and the handle pieces 131', 132') and the inner lid 140' (and the handle piece 141') have been separately rotated both with respect to each other and with respect to the container component 110 (which remains unchanged) which is shown by the position of the mark 135' with respect to the lug 115. Accordingly, the outer lid 130' is not aligned with the inner lid 140' in the specified alignment in which all of the handle pieces 131', 132', 141' would be aligned, and the outer lid 130' and inner lid 140' are not aligned with the container component 110 in the specified alignment that would be obtained by alignment of the mark 135' and lug 115. In the illustrated example state, the lid assembly 120' cannot be easily removed from the container component 110 in the orientation shown, i.e. it is child-resistant to opening. To remove the lid, a user would align the inner lid 140' and the outer lid 130' of the lid assembly 120', as well as then aligning the lid assembly 120' with the lug 115 on the container component 110, to an orientation like that shown in FIG. 1.

Figure 13:
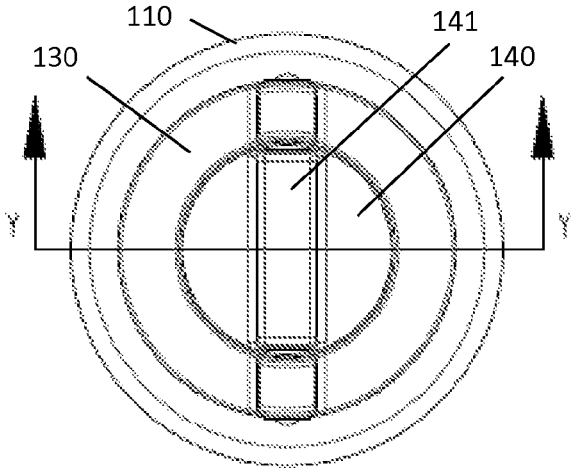
FIG. 13 is a top plan view of the bottle with showing a direction of a section Y-Y according to an embodiment of the system described herein.
Figure 14:
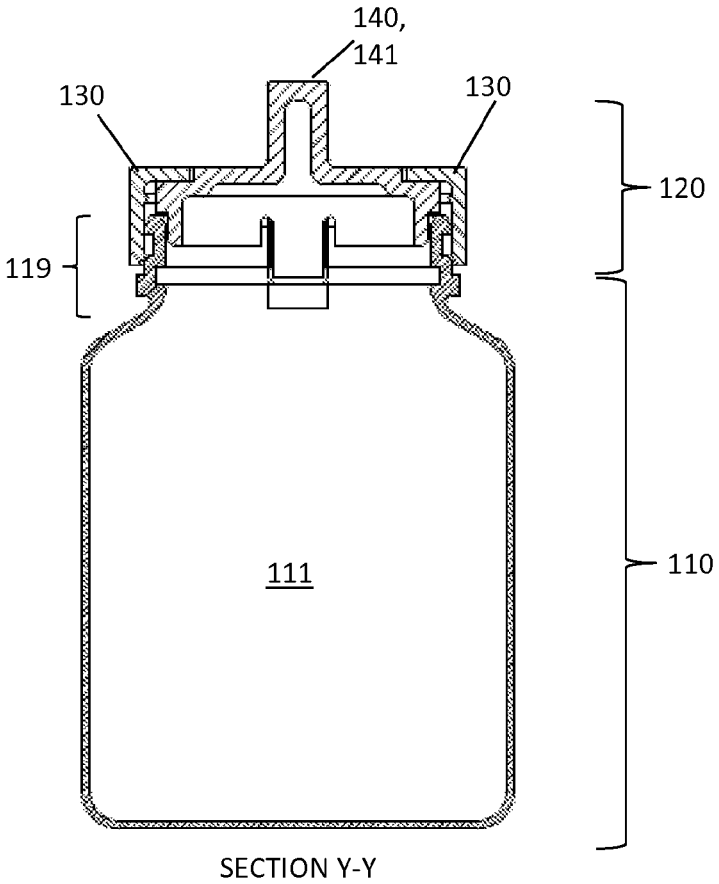
FIG. 14 is a cross sectional view of the section Y-Y shown in FIG. 13.

FIGS. 13 and 14 are views of the bottle 100 for an illustrated section Y-Y according to an embodiment of the system described herein. FIG. 13 is a top plan view of the bottle 100 with showing a direction of the section Y-Y. FIG. 14 is a cross-sectional view of the section Y-Y shown in FIG. 13. The engagement of the rim section 119 with the lid assembly 120 is shown in the cross-sectional view.

Figure 15:
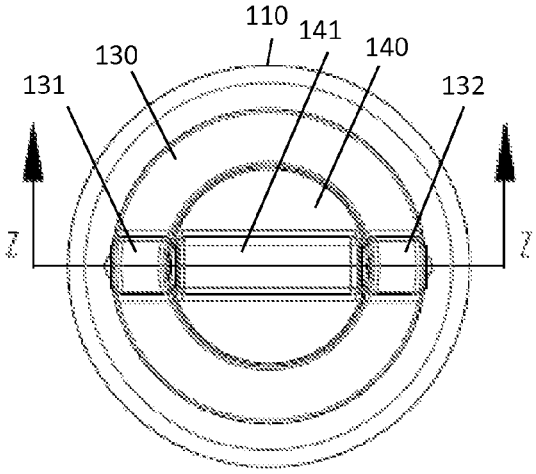
FIG. 15 is another top plan view of the bottle with showing a direction of a section Z-Z according to an embodiment of the system described herein.
Figure 16:
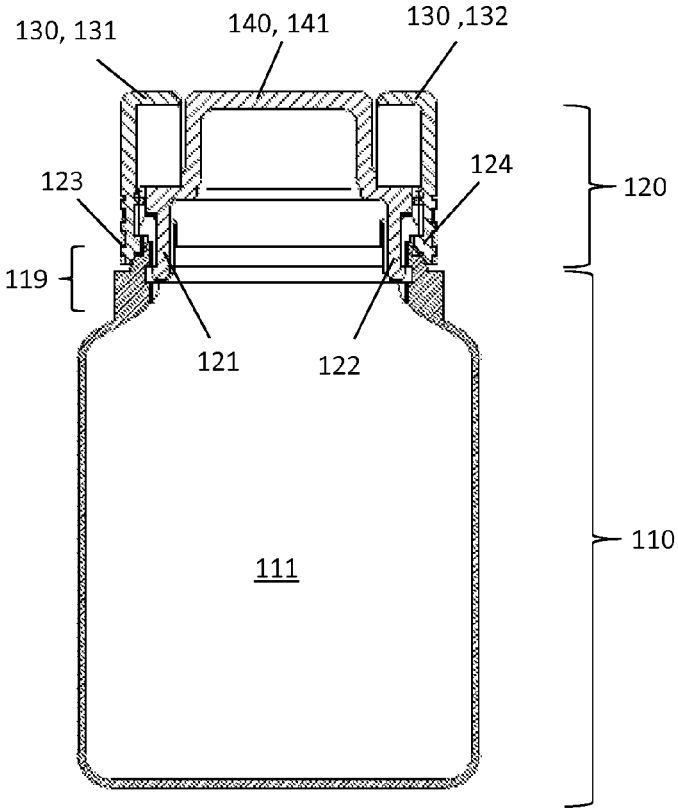
FIG. 16 is a cross sectional view of the section Z-Z shown in FIG. 15.

FIGS. 15 and 16 are views of the bottle for an illustrated section Z-Z according to an embodiment of the system described herein. FIG. 15 is a top plan view of the bottle with showing a direction of the section Z-Z. FIG. 16 is a cross-sectional view of the section Z-Z shown in FIG. 15. The engagement of the rim section 119 with the lid assembly 120, including tabs discussed elsewhere herein, is shown in the cross-sectional view.

Figure 17:
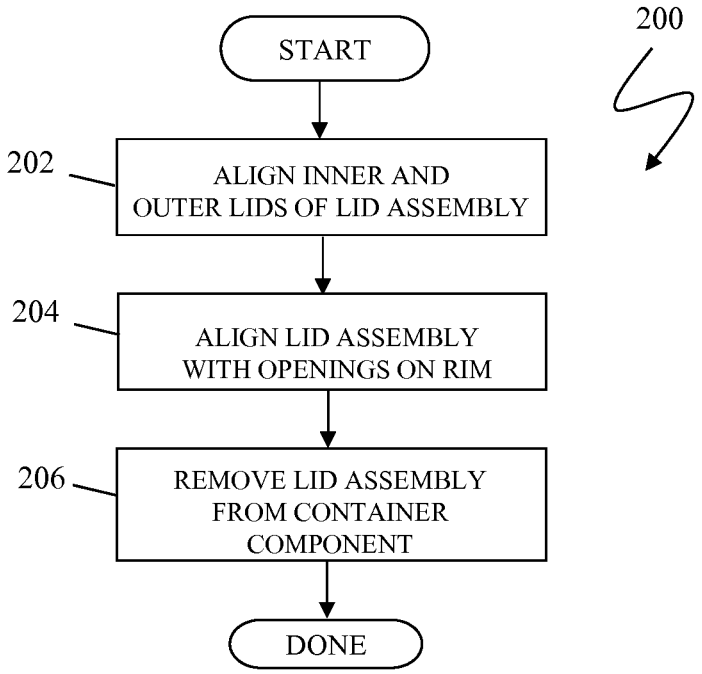
FIG. 17 is a flow diagram describing processing steps for removing the lid assembly from the container component of the bottle according to an embodiment of the system described herein.

FIG. 17 is a flow diagram 200 describing processing steps for removing the lid assembly 120 from the container component 110 of the bottle 100 according to an embodiment of the system described herein. At a step 202, a user aligns the inner lid 140 with the outer lid 130 of the lid assembly 120. The user may turn each of the inner lid 140 and the outer lid 130 separately to align the lids 130, 140 by grasping the handle pieces 141, 131 and/or 132. Alignment of the inner lid 140 and the outer lid 130 of the lid assembly 120 is performed when the handle pieces 141, 131 and 132 are positioned in a line. After the step 202, in a step 204, the user may then align the lid assembly 120 with the lugs 115, 116 of the rib 112 of the container component 110. The user may turn the lids 130, 140 together and align the entire lid assembly 120 with the lugs as facilitated by the marks 135, 136 that provide visual and/or tactile aides. Alignment may be facilitated by the user using the marks 135, 136 on the surface of the outer lid 130. It is noted that the order of steps 202 and 204 may be changed. For example, the user may first align the outer lid 130 with the lugs 115, 116 and then turn the inner lid 140 to align the inner lid 140 with the outer lid 130.

After the step 204, the user then proceeds to a step 206 to lift off the lid assembly 120. There is some resistance to the lift procedure in the form of the engagement of tabs 121, 122, 123, 124 of the inner and outer lids 130, 140 with the rounded edges of the rim section 119, even when the outer and inner lids 130, 140 are in alignment with the opening(s) 117 of the rim section 119. The resistance prevents the lid assembly 120 from simply falling off, for example, if the bottle 100 is dropped when the lid assembly 120 is in alignment for removal from the container component 110; however, the resistance is relatively easily overcome by application of a small force by the user to pry off the lid assembly 120 that causes a small deflection of the tabs 121, 122, 123, 124 to disengage them from the rim section 119 in the area of the opening(s) 117. After the step 206, the removal procedure of the lid assembly 120 is complete.

Figure 18:
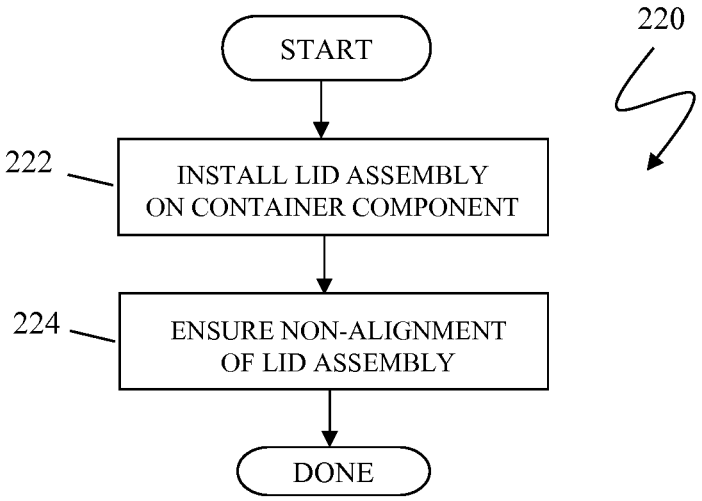
FIG. 18 is a flow diagram describing processing steps for installing the lid assembly onto the container component of the bottle according to an embodiment of the system described herein.

FIG. 18 is a flow diagram 220 describing processing steps for installing the lid assembly 120 onto the container component 110 of the bottle 100 according to an embodiment of the system described herein. At a step 222, the lid assembly 120 is pressed onto the rim section 119 of the container component 110. As described elsewhere herein, it is noted that installing the lid assembly 120 on the container component 110 does not require alignment of the lid assembly 120 with openings or lugs nor aligning of the outer lid 130 and the inner lid 140. The lid assembly 120 should be pressed with sufficient force to cause the tabs 121, 122, 123, 124 to engage over rounded edges of the rim section 119. After the step 222, in an optional safety step 224, the user should ensure that the outer and inner lids 130, 140 are not aligned and/or that the lid assembly 120 is not aligned with the lugs 115, 116 and thereby is not aligned with the opening(s) 117 of the rim section 119. In this way, the bottle 100 provides child safety features to prevent removal of the lid assembly 120 should a child interact with the bottle 100. After the step 224, the installing procedure of the lid assembly 120 is complete.

Various embodiments discussed herein may be combined with each other in appropriate combinations in connection with the system described herein. Further, it is noted that although the system is described herein principally in connection with a bottle having a round opening, the system described herein may be used appropriately in connection with containers of any suitable shape or size, including a container having a square or rectangular opening, and specifically in which the lids of the lid assembly of the container may be aligned by suitable movements other than rotation, such as linear sliding movements and/or other appropriate relational movements of the inner lid with respect to the outer lid and of the outer and inner lids with respect to the container component. Additionally, in some instances, the order of steps in flowcharts, flow diagrams and/or described flow processing may be modified, where appropriate.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A bottle assembly comprising:

a container component; and a lid assembly that engages with the container component and is rotatable with respect to the container component, wherein the lid assembly includes an outer lid and an inner lid, wherein the inner lid is independently movable with respect to the outer lid, and wherein the lid assembly provides child-resistant removal features such that the lid assembly is removable from the container component only when:

the inner lid is positioned at a first specified alignment with respect to the outer lid; and the outer lid is positioned at a second specified alignment with resect to the container component, wherein the inner lid includes a handle piece that is aligned with at least one other handle piece of the outer lid in the first specified alignment of the inner lid and the outer lid, and wherein the inner lid and the outer lid are both aligned in the second specified alignment with respect to the container component.

2. The bottle assembly according to claim 1, wherein the inner lid is positioned within a circumference of the outer lid, and wherein the inner lid is independently rotatable with respect to the outer lid.

3. The bottle assembly according to claim 1, wherein the container component includes a rim section having at least one opening, and wherein the second specified alignment of the outer lid is an alignment of the outer lid with respect to the at least one opening of the rim section of the container component.

4. The bottle assembly according to claim 3, wherein the rim section of the container component includes at least one lug that provides an indication of a location of the at least one opening of the rim section.

5. The bottle assembly according to claim 1, wherein the outer lid and the inner lid each include at least one tab that engages with a rim section of the container component, and wherein the at least one tab of each of the outer lid and the inner lid are aligned in the first specified alignment of the inner lid with respect to the outer lid.

6. The bottle assembly according to claim 5, wherein each of the at least one tabs engages with a rib of the rim section to provide child-resistant removal features of the lid assembly when the lid assembly is not in the first specified alignment of the inner lid with respect to the outer lid or in the second specified alignment of the outer lid with respect to the container component.

7. The bottle assembly according to claim 1, wherein the outer lid includes at least one visual or tactile aid to facilitate alignment of the outer lid in the second specified alignment of the outer lid with respect to the container component.

8. A method for providing child-resistant access to a bottle assembly, comprising:

providing the bottle assembly with a container component and a lid assembly that engages with the container component and is rotatable with respect to the container component, wherein the lid assembly includes an outer lid and an inner lid, wherein the inner lid is independently moveable with respect to the outer lid;

providing child-resistant removal features of the bottle assembly such that the lid assembly is removable from the container component only when:

the inner lid is positioned at a first specified alignment with respect to the outer lid; and the outer lid is positioned at a second specified alignment with respect to the container component, wherein the inner lid includes a handle piece that is aligned with at least one other handle piece of the outer lid in the first specified alignment of the inner lid with respect to the outer lid, and wherein the inner lid and the outer lid are both aligned in the second specified alignment with respect to the container component.

9. The method according to claim 8, wherein the inner lid is positioned within a circumference of the outer lid, and wherein the inner lid is independently rotatable with respect to the outer lid.

10. The method according to claim 8, wherein the container component includes a rim section having at least one opening, and wherein the second specified alignment of the outer lid is an alignment of the outer lid with respect to the at least one opening of the rim section of the container component.

11. The method according to claim 10, wherein the rim section of the container component includes at least one lug that provides an indication of a location of the at least one opening of the rim section.

12. The method according to claim 8, wherein the outer lid and the inner lid each include at least one tab that engages with a rim section of the container component, and wherein the at least one tab of each of the outer lid and the inner lid are aligned in the first specified alignment of the inner lid with respect to the outer lid.

13. The method according to claim 12, wherein each of the at least one tabs engages with a rib of the rim section to provide child-resistant removal features of the lid assembly when the lid assembly is not in the first specified alignment of the inner lid with respect to the outer lid or the second specified alignment of the outer lid with respect to the container component.

14. The method according to claim 8, wherein the outer lid includes at least one visual or tactile aid to facilitate alignment of the lid assembly in the second specified alignment of the outer lid with respect to the container component.

* * * * *